United States Patent [19]

Andrews

[11] 4,431,065

[45] Feb. 14, 1984

[54] UNDERREAMER

[75] Inventor: Thomas L. Andrews, Costa Mesa, Calif.

[73] Assignee: Smith International, Inc., Newport Beach, Calif.

[21] Appl. No.: 352,775

[22] Filed: Feb. 26, 1982

[51] Int. Cl.[3] ..... E21B 10/32; E21B 10/46

[52] U.S. Cl. ..... 175/269; 175/279; 175/406; 175/410

[58] Field of Search ..... 175/267, 269, 273, 274, 175/279, 409, 410, 329, 53, 406, 407, 280, 413

[56] References Cited

U.S. PATENT DOCUMENTS

| | | | |
|---|---|---|---|
| 2,693,938 | 11/1954 | Roberts | 175/406 |
| 2,922,627 | 1/1960 | Kammerer | 175/410 |
| 2,940,522 | 6/1960 | Taylor et al. | 175/269 |
| 3,106,973 | 10/1963 | Christensen | 175/410 |
| 3,140,748 | 7/1964 | Engle et al. | 175/410 |
| 3,425,500 | 2/1969 | Fuchs | 175/269 |
| 3,750,771 | 8/1973 | Cugini | 175/269 |
| 3,938,599 | 2/1976 | Horn | 175/329 |
| 4,203,496 | 5/1980 | Baker et al. | 175/329 |
| 4,334,585 | 6/1982 | Upton | 175/410 |

FOREIGN PATENT DOCUMENTS

| | | | |
|---|---|---|---|
| 47906 | 6/1979 | Fed. Rep. of Germany | 175/410 |

*Primary Examiner*—Ernest R. Purser
*Assistant Examiner*—William P. Neuder
*Attorney, Agent, or Firm*—Christie, Parker & Hale

[57] ABSTRACT

An underreamer utilizes a plurality of cutting arms each having a plurality of tungsten carbide inserts, some of which have synthetic diamond cutting surfaces. There is a synthetic diamond gage cutter at the outer end of each cutting arm, and at least one other synthetic diamond cutter located more inwardly on the arm. The gage cutter is offset a greater distance from the leading side of the arm than are such other cutters. Recessed regions in front of the synthetic diamond cutters expose their full cutting faces while leaving steel for support of the cutters. Tungsten carbide inserts on the ends of the cutting arms between the leading side and the gage cutter minimize erosion of the steel arm and help prevent the gage cutter from being dislodged. The underreamer includes a hydraulic plunger for activating the cutting arms from a fully retracted to a fully deployed position, and a nozzle which ejects fluid toward the arm cutting surfaces during deployment and operation of the cutting arms.

58 Claims, 10 Drawing Figures

UNDERREAMER

FIELD OF THE INVENTION

This invention pertains to apparatus for drilling bore holes in the earth. More particularly, an underreamer is disclosed which utilizes cutting arms having synthetic diamond cutting surfaces for enlarging a bore hole.

BACKGROUND OF THE INVENTION

During the course of drilling an oil well or the like, it is often desirable to expand the diameter of the drill hole below a certain point in the rock formation. An underreamer is a tool lowered in the bore of the hole to do just that. The tool fits rather snugly in the hole. When the desired depth is reached, the underreamer is made to rotate and cutting arms are extended laterally from its body to ream or enlarge the hole. The arms can be retracted for withdrawing the underreamer from the hole.

As the function of the underreamer is to cut rock, it is necessary to employ extremely hard cutting surfaces. Accordingly, tungsten carbide inserts or natural diamonds have been placed on underreamer cutting arms to provide hard cutting surfaces. The high cost of natural diamonds, however, restricts their practical size to a small effective cutting surface.

It is therefore desirable to provide a cutting arm for an underreamer which utilizes synthetic diamonds, which can for a lower cost be made much larger than natural diamonds.

One problem impeding the use of large area synthetic diamonds is the development of excessive heat at the diamond during underreaming. Another problem is accumulation of cuttings on the cutting arm adjacent the diamond cutting surface which restricts the ability of the diamond to cut further material.

Large area synthetic diamond inserts can be mounted in cutter arms of an underreamer, however they must be placed to avoid undue weakening of the arms which could lead to loss of such inserts and to assure cutting of all portions of the rock formation being reamed.

There is need for a cutting arm which incorporates synthetic diamonds of relatively large surface area. The need extends to an underreamer which uses cutting arms including synthetic diamonds and which does not suffer from the limitations described above.

SUMMARY OF THE INVENTION

To address the described needs, this invention provides a cutting arm for an underreamer, and an underreamer which utilizes synthetic diamond cutting surfaces. The invention obviates the problems of overheating and accumulation of rock cuttings and provides equipment which may be economically incorporated into existing drillhole technology.

An underreamer comprises a tubular body for connection to a drill string or the like, a cutting arm, a recess for receiving the cutting arm, actuation means for moving the cutting arm between a retracted position approximately aligned with the axis of the tubular body and a deployed position extending laterally outwardly of the body, and nozzle means, whereby upon movement of the cutting arm away from the retracted position, fluid supplied to the tubular body from the drill string or the like communicates through the nozzle means and the recess to flood the hole being reamed at the synthetic diamond cutting faces carried by the cutting arm.

The cutting arm for this or other underreamers comprises a steel body having a leading side, a trailing side, an outer end face and means for connecting the arm to the underreamer. A plurality of receptacles in the body each contain a tungsten carbide insert. At least a portion of the inserts comprise cutters. Each cutter has a diamond cutting face facing in the same general direction as the leading side of the arm. A gage cutter is adjacent the end face of the arm for cutting the gage of a hole being reamed. At least one tungsten carbide insert is in the arm end face between the leading side and the gage cutter for minimizing erosion of the end face.

DESCRIPTION OF THE DRAWINGS

These and other features and advantages of the invention will be more readily understood by reason of the following detailed description when considered in conjunction with the following drawings, wherein.

DETAILED DESCRIPTION

The underreamer 10 has a cylindrical tubular steel body 11. The upper end 12 of the underreamer is adapted for connection to a conventional drill string, preferably by means for a conventional threaded coupling (not shown). The opposite or lower end 13 preferably includes a conventional bullnose (also not shown). It should be understood that the threaded coupling and the bullnose do not form a part of this invention.

Figure 1:
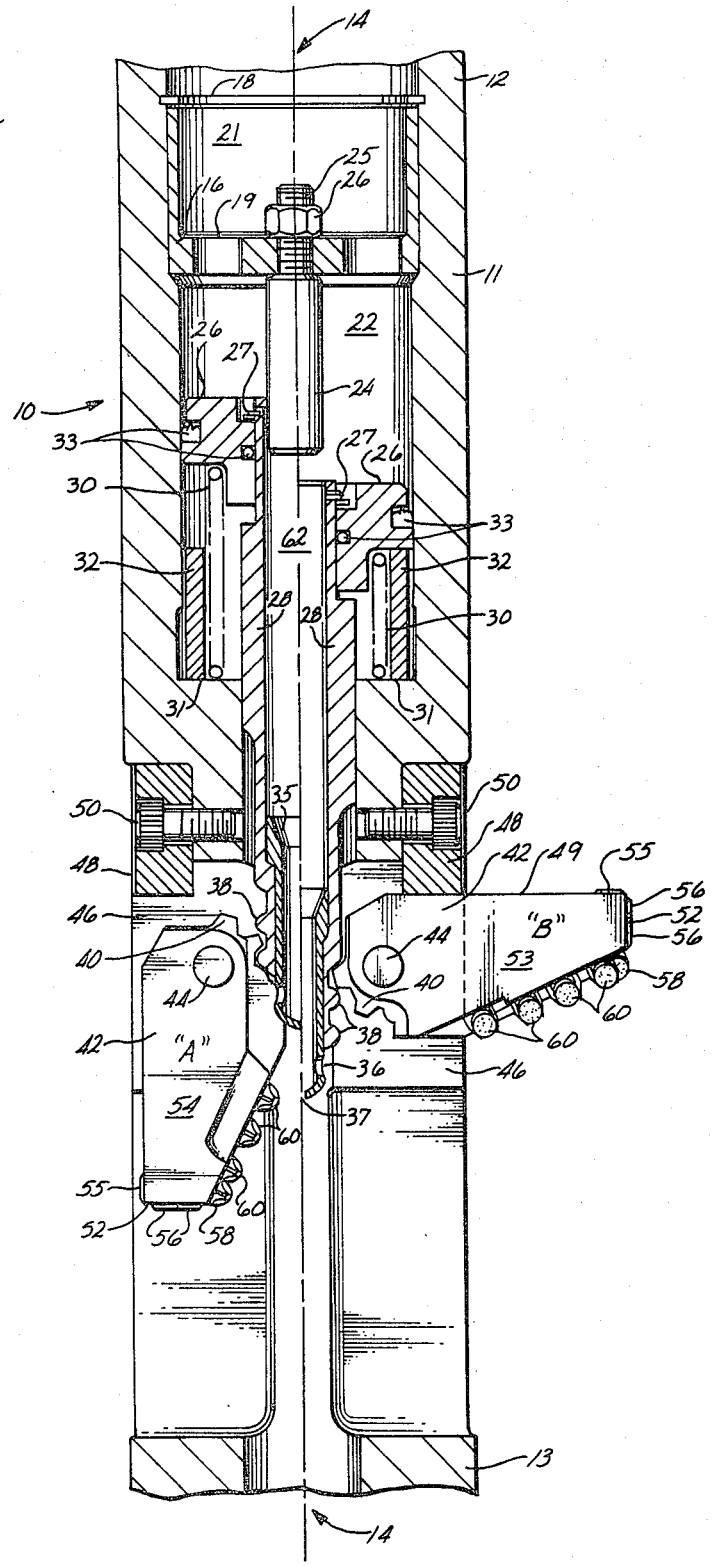
FIG. 1 is a longitudinal cross-section of an underreamer constructed according to this invention.

The underreamer has a central axis 14 about which rotation occurs during operation. In FIG. 1, the drawing is divided into two portions on either side of axis 14. The left hand side of the drawing illustrates the underreamer with one of its cutting arms 42 in a fully retracted position "A", while the right hand portion of FIG. 1 illustrates the configuration of the underreamer with the cutting arm 42 in a fully deployed position "B". Other portions of the mechanism are in the positions they occupy when the arms are retracted (left half of the drawing) or deployed (right half of the drawing).

At the upper end of the underreamer a mounting spider 16 is secured to the inner wall of the body by a snap ring 18. Fluid can flow through passages 19 in the spider. The spider separates the internal volume of the underreamer into upper and lower chambers 21 and 22. In operation, drilling fluid or the like pumped from the drill string coupled to the upper part of the underreamer flows into the chamber 21 and through the passages 19 into the lower chamber 22. The spider supports an axial cylindrical plug 24. This plug has a threaded shank 25 and is secured to the spider 16 by means of a nut 26. At the lower end of the lower chamber 22 is a piston head 26. The piston is secured to an actuating tube 28 by means of rings 27. The tube has an axial passage 62 the upper end of which slides over the plug 24 and restricts the passage to fluid flow when the piston is in a raised position corresponding to retraction of the cutting arms.

The piston head 26 is resiliently biased upwardly by a spring 30 which is set against a shoulder 31 where the interior bore of the underreamer body narrows. A stop ring 32 extending upwardly from the shoulder presets a maximum downward movement of the piston head in operation, as is illustrated on the right hand portion of FIG. 1. Seals 33 minimize fluid flow past the piston.

The lower portion of the actuating tube 28 includes a nozzle cap 35 which terminates in three laterally directed nozzle openings 36. A plurality of gear teeth 38 on the outer portion of the actuating tube mesh with a corresponding set of teeth 40 on each of three cutting arms 42. In the presently preferred embodiment, there are three cutting arms 42 evenly spaced 120° apart around the underreamer axis 14, and three nozzle openings 36 each associated with the centerline of a respective cutting arm. A downwardly directed nozzle opening 37 in the end of the nozzle cap helps keep the body clear of obstructing cuttings. Each cutting arm is mounted in the underreamer by means of a hinge pin 44 and can move between a fully retracted position "A" substantially aligned with the body of an underreamer, shown in the left hand portion of FIG. 1, and a fully deployed position "B", with the arm extending outwardly from the underreamer body, shown in the right hand portion of FIG. 1.

To permit movement of the cutting arms in and out of the underreamer body, there is provided a recess 46 along the path of movement of each cutting arm. A check stop 48 in the side of the underreamer body just above the recess 46 limits the angular extension of the cutting arms. In the presently preferred embodiment, the arm upper surface 49 and the surface of the stop 48 cooperate so that the cutting arm upper surface is at substantially right angles to the underreamer axis 14 when in the fully deployed position "B". The stop is held in place by a bolt 50.

Each steel cutting arm is roughly trapezoidal having an outer end 52 opposite from the hinge 44, and a leading side 53 and a trailing side 54 by reference to the normal direction of rotation of the underreamer about its axis 14. In FIG. 1, the leading side 53 of an arm is shown in position "B", while the trailing side 54 of an arm is shown in position "A" on the left hand portion of the diagram.

Each cutting arm includes a plurality of wear-resistant cutting surfaces defined by tungsten carbide inserts 55 and 56, a first synthetic diamond gage cutter 58 and a plurality of other synthetic diamond cutters 60.

When it is time to lower the underreamer in the bore of a drill hole, the arms 42 are fully retracted as in position "A", and the underreamer is coupled to the bottom of a conventional drill string or the like. The underreamer is lowered into the drill hole to the desired location, and drilling fluid is pumped into the upper chamber 21, through the passages 19 into the lower chamber 22, and against the piston head 26. The hydraulic pressure forces the piston assembly down against the resiliency of the spring 30 until the top of the piston and actuating tube 28 clear the plug 24, as in the right hand portion of FIG. 1. Fluid then flows freely through the passage 62 into the nozzle cap 35. The partial blocking of the fluid passage by the plug assures higher pressure on the piston assembly to initiate opening of the underreamer to its deployed state.

The downward motion of the piston head 26 forces the actuating tube 28 downwardly and, along with it, the gear teeth 38. This causes the cutting arms 42 to swing outwardly from the fully retracted position "A" toward the fully deployed position "B". Initially the cutting surfaces defined by the tungsten carbide inserts 55 on the top of the cutting arms engage rock formation adjacent the bore hole and commence enlargement of the hole to permit full arm extension. The cutting action is continued by the tungsten carbide inserts on the outer ends of the arms. Once the cutting arm has "started" itself in the rock formation, the process of arm extension occurs readily. The plug 24 is long enough to remain in the axial passage 62 until the cutting arms have sufficiently extended that the forces due to engaging the rock tend to further deploy the arms. This assures adequate hydraulic force on the piston during early stages of deployment to overcome the inwardly directed forces of reaming. Such hydraulic force is not needed after the arms are deployed and downward drilling action started.

The length of the plug 24 is selected in cooperation with the position of the cutting arm 42 so that fluid flows out of the nozzles 36 to flood the cutting surfaces only when the cutting arm is in a partially or fully deployed position. Thus, the piston clears the plug 24 to increase the flow of fluid out of the nozzle 36 at the point where the first synthetic diamond gage cutter 58 is initially exposed to rock formation outside the main body of the underreamer.

Upon downward movement of the piston past the central plug 24, drilling fluid communicates with the interior volume of the actuating tube and with the nozzle cap 35. Hydraulic pressure forces drilling fluid out the nozzle openings 37 and the recesses 46 toward the cutting arms. The relief on the trailing side of the cutting arm permits fluid to flow from the nozzle opening, aligned with the arm centerline, toward the arm cutting surfaces. The fluid floods the drill hole, cooling the cutting surfaces of the arms and preventing excessive heat buildup during underreaming. The fluid also helps clear out debris from around the synthetic diamond cutters and impedes fouling of the cutting surfaces by accumulation of debris.

There is preferably an opening 37 at the bottom of the nozzle cap which helps clean the bottom of the underreamer by permitting fluid to flood directly below the pin. Some beneficial effect has been observed from using a large volume total flow with a minor proportion of fluid being directed toward the side of the rock formation. Accordingly, if desired, the nozzle openings 36 may take the form of longitudinal slots near the lower end of the nozzle pin aligned with the arm centerline.

When underreaming is completed, it is desirable to remove the underreamer from the drill hole. This is accomplished by raising the underreamer off the cutting face and controllably lowering the hydraulic pressure supplied to the underreamer so that the resiliency of the spring 32 overcomes the hydraulic pressure. The spring action forces the piston 26 upwardly which in turn causes the actuating tube 28 to move upwardly and, by the meshing of the gear teeth 38 and 40, in turn causes the cutting arms 42 to retract to the fully retracted position "A". The underreamer may then be removed from the drill hole. The closing acton due to the spring can be augmented by pulling the underreamer upwardly against the top of the reamed part of the hole.

The underreamer has been described in the context of the presently preferred embodiment which includes three cutting arms 42 which are equally spaced 120° apart about axis 14. It will be appreciated, however, that an underreamer may have any number of cutting arms.

FIGS. 2 to 8 illustrate a set 90, 91 and 92 of present preferred cutting arms for the underreamer of FIG. 1, two of which are identified with reference numeral 42 in FIG. 1. The basic structure of the cutting arms is the same with the placement of synthetic diamond cutting surfaces being different on each arm to facilitate complete coverage of the volume that is to be reamed out. The arm illustrated in FIG. 6 corresponds to FIGS. 2 and 3, while FIG. 7 corresponds to FIG. 4, and FIG. 8 to FIG. 5.

Figure 2:
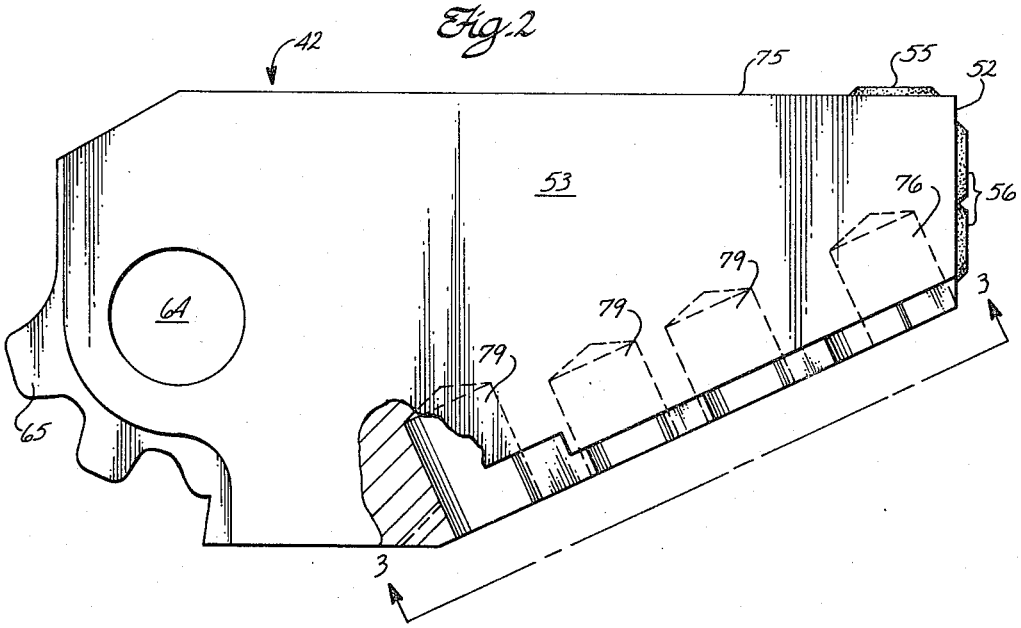
FIG. 2 is a side elevation of a cutting arm constructed according to this invention.
Figure 3:
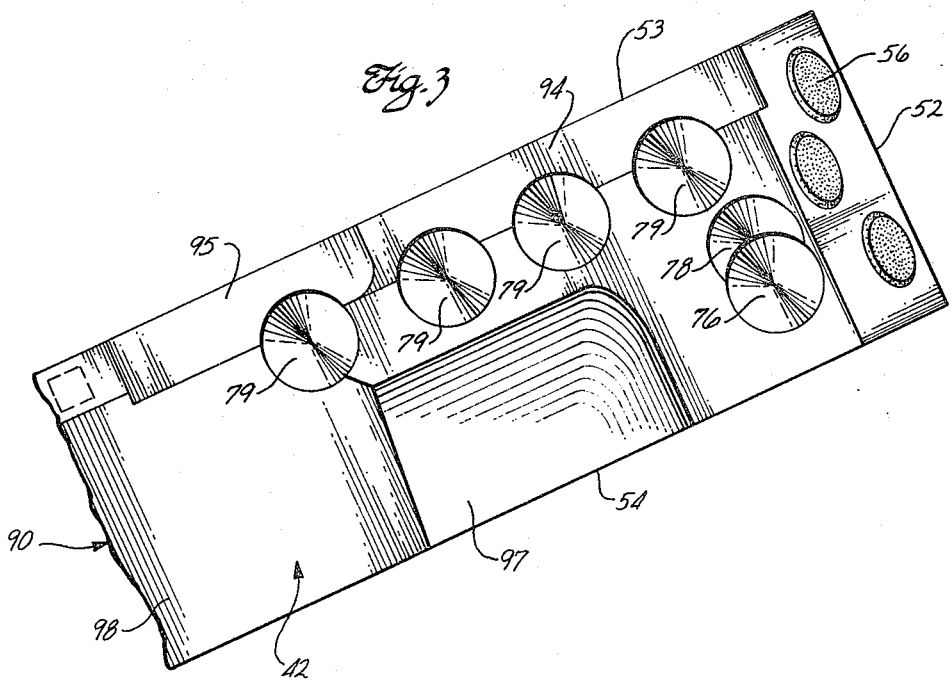
FIG. 3 is a bottom view of the arm of FIG. 2.
Figure 4:
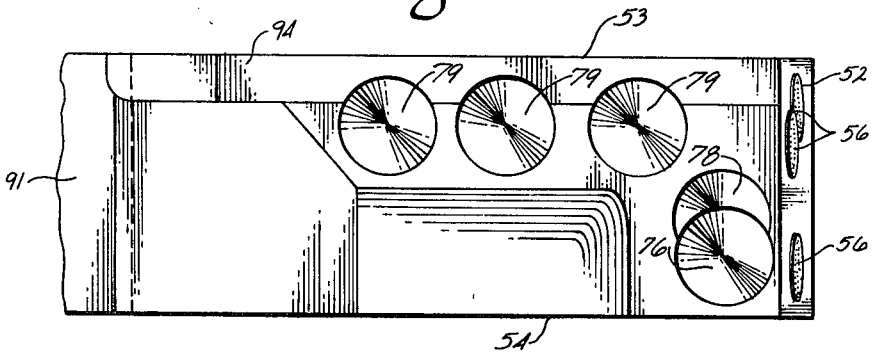
FIG. 4 is a bottom view of a second arm of a set of three cutting arms for the underreamer of FIG. 1.
Figure 5:
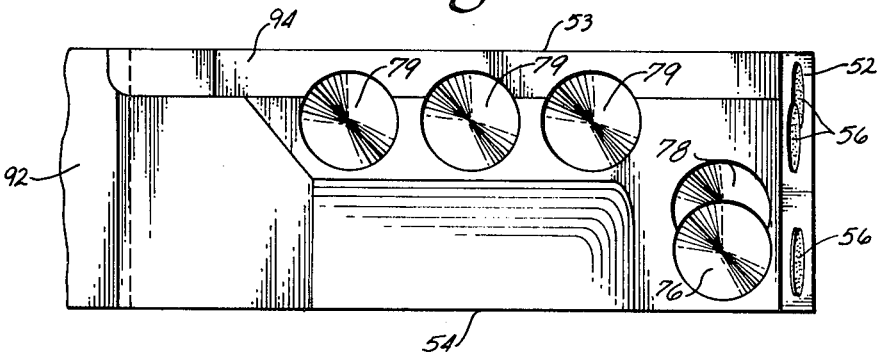
FIG. 5 is a bottom view of the third cutting arm of the presently preferred set of cutting arms.

FIGS. 2 and 3 show basic features common to all the cutting arms of the set. The exemplary cutting arm include a hinge pin passage 64 near the inner end of the arm for hingeably mounting the cutting arm in the underreamer. A gear tooth surface 65 is formed in the arm body to cooperate with the gear teeth 38 of the underreamer actuating tube for deploying and retracting the arm.

The cutting arm includes an outer end 52, a leading side 53 and a trailing side 54 which are defined by reference to the intended direction of rotation of the underream in operation. The leading side 53 of the cutting arm is depicted face on in FIGS. 2, 6, 7 and 8.

Each cutting arm includes a plurality of tungsten carbide inserts which include one or two cylindrical tungsten carbide inserts 55 on the top of the arm, a plurality of cylindrical tungsten carbide inserts 56 on the outer end 52 of the arm, a tungsten carbide insert including a synthetic diamond cutting face forming gage cutter 58, and a plurality of additional or auxiliary tungsten carbide inserts having cutting faces forming synthetic diamond cutters 60 near the leading side of the arm. Although referred to herein as "auxiliary cutters" it will be recognized that these cutters 60 collectively cut most of the rock removed in reaming a bore hole. The term "auxiliary" is used herein merely to distinguish such cutters from the gage cutters 58. The tungsten carbide inserts 56 located on the outer end face 52 of the arm are adjacent the gage of the hole during underreaming and help maintain the gage as well as protect the end of the arm from premature wear.

In an exemplary embodiment there are nine 5/16" diameter tungsten carbide inserts on the end face of the cutting arm, while there are three such inserts on the arm back face. These inserts are preferably fabricated of tungsten carbide because of the hardness of that material. The inserts on end face 52 are preferably staggered with respect to each other so that when the cutting arm is in motion rotating about the central axis of the underreamer, the inserts sweep most of the area covered by the end face. It is preferable to incorporate a larger number (9) of relatively small (5/16" diameter) tungsten carbide inserts on the arm end face rather than a smaller number (3) of larger (9/16" diameter) inserts so that the area of steel exposed between the inserts is minimized to prevent premature loss of the tungsten carbide inserts or the gage cutter.

The synthetic diamond gage cutter 58 is located on the arm adjacent the arm outer end. The gage cutter is oriented to present a cutting face 77 facing in the general direction of the leading side of the cutting arm. There is a counterbore 78 defined in the arm just in front of the cutting surface of the gage cutter.

Figure 9:
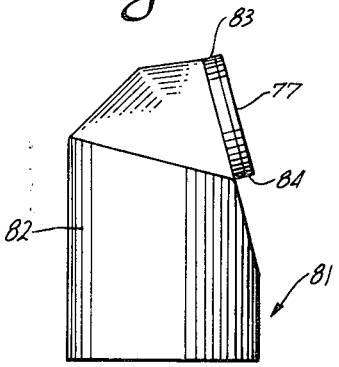
FIG. 9 is a perspective view of a synthetic diamond cutter for the cutting arms of FIGS. 2 to 8.

A typical synthetic diamond cutter used in the cutting arm is illustrated in FIG. 9. The cutter is fabricated as an insert and includes a tungsten carbide body 82, a tungsten carbide substrate 83, and a synthetic diamond cutting surface 84. A layer of polycrystalline diamond 84 is bonded to the tungsten carbide substrate in a conventional high-pressure/high-temperature process. The tungsten carbide substrate is brazed to the tungsten carbide body 82. The resulting assembly has the hardness and wear resistance of diamond complemented by the impact resistance of cemented tungsten carbide. One such assembly is currently known to the art by the General Electric trademark "STRATAPAX". In use, due to continued microchippage of the diamond cutting surface during underreaming, a fresh sharp cutting edge is presented continually.

Receptacles are bored into the body of the cutting arm to receive the synthetic diamond cutters. FIG. 2 shows the location of such receptacles for the gage cutter 58 (bore 76) and for the other synthetic diamond cutters 60 (bores 79). Preferably the gage cutter and the other synthetic diamond cutters are dimensioned the same so that they are interchangeable, which reduces the cost of fabrication of the cutting arms.

In FIG. 3, it can be seen that the recess 78 is formed by counterboring the cutting arm in front of the gage cutter receptacle 76. The bores 76 and 79 are made about 0.0015 inch less than the diameter of the body of the synthetic diamond cutters which are tightly press fitted into the appropriate bore. The tungsten carbide inserts are also press fit into bored receptacles on the end or the back face of the cutting arm as appropriate.

Figure 6:
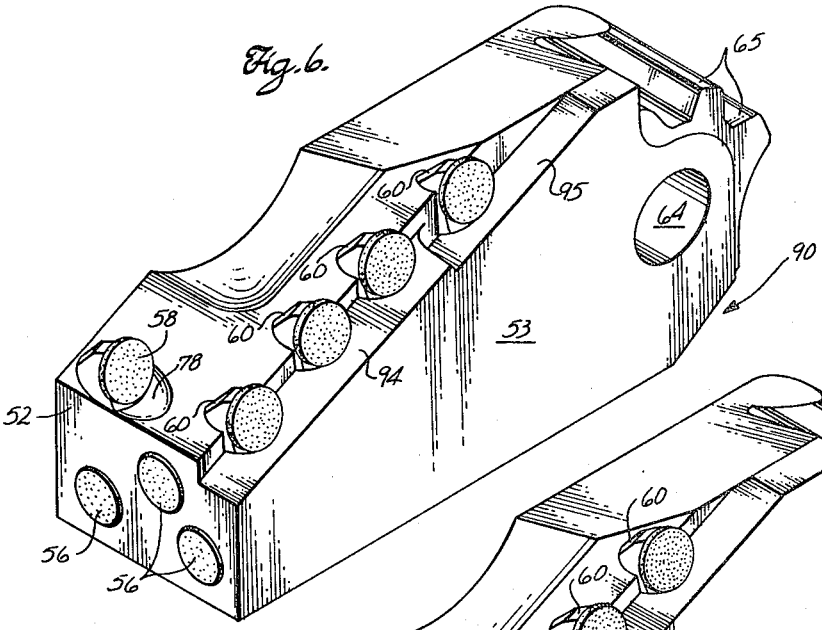
FIGS. 6, 7 and 8 are perspective views of the set of cutting arms of FIGS. 3, 4 and 5 respectively.
Figure 7:
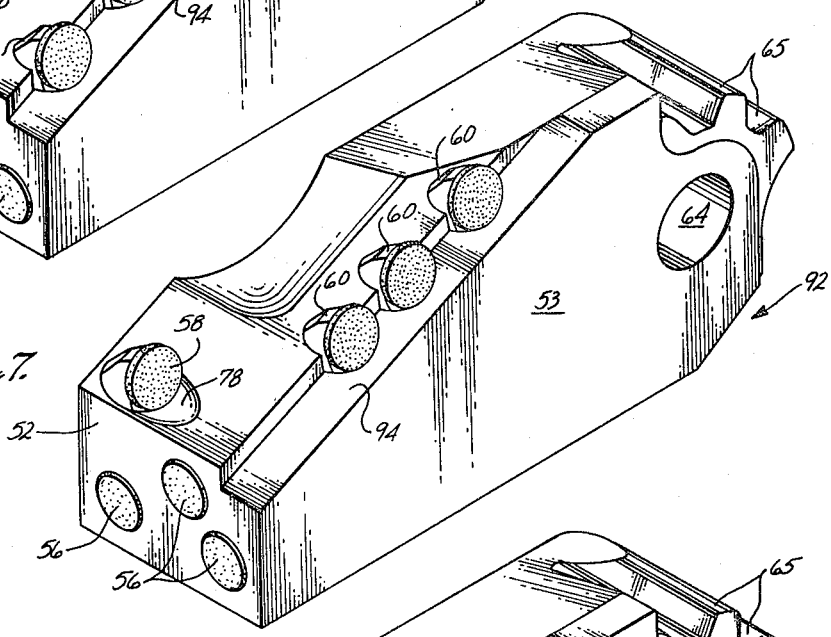
Figure 8:
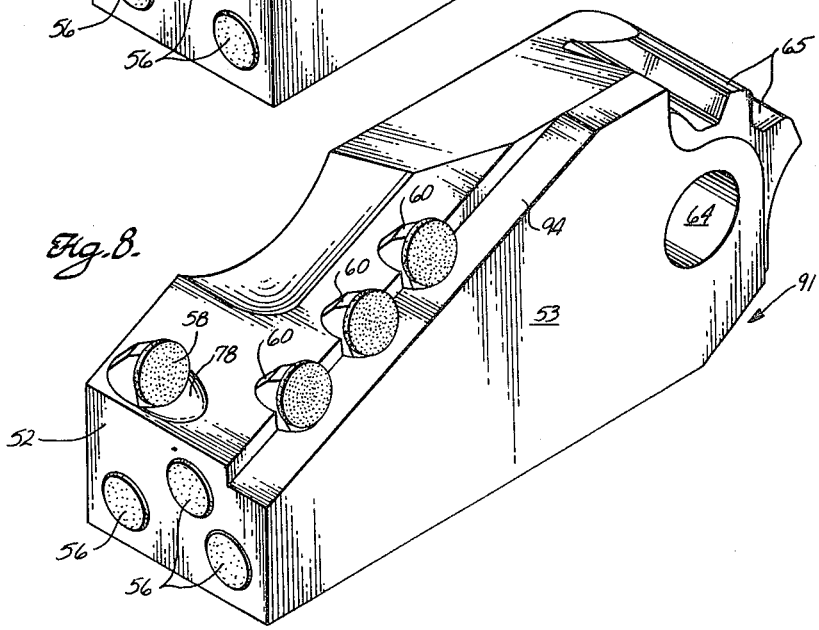

FIGS. 6, 7 and 8 show a complete set of presently preferred cutting arms 90, 91 and 92 for the underreamer of FIG. 1. Each of the cutting arms 90, 91 and 92 has a synthetic diamond gage cutter 58 located near the outer end face 67 of the cutting arm. The major difference between cutting arms 90, 91 and 92 is the number and placement of the other synthetic diamond cutters 60. Thus, in arm 90 (FIG. 6) there are four such other cutters in a row set back from the leading side 54 of the cutting arm; in cutting arm 91 illustrated in FIG. 7, and in cutting arm 92 of FIG. 8, there are only three such other synthetic diamond cutters. The number and location of the synthetic diamond cutters on any given cutting arm are cooperatively related to the location of all diamond cutters in the entire set of cutting arms so that during operation of the underreamer, the gage cutters 58 and the other cutters 60 cooperate to sweep substantially the entire volume swept out by the cutting arm. In this way, the entire face of rock formation being reamed is cut by the collective action of the cutters.

There is a recessed shelf 94 in the cutting arm from its leading face 54 to those locations where the other synthetic diamond cutters are press fitted into the cutting arm. The shelf 94, as does the counterbore 78, functions to impede accumulation of cuttings about the cutting surfaces presented by the synthetic diamond cutters. When the cutting arms are used in conjunction with the underreamer of FIG. 1, where the nozzle openings 36 direct fluid at each cutting arm, the flow of fluid has maximum beneficial effect when a shelf 94 and recess 78 are provided in the cutting arm on the leading side of the cutters.

The relief provided by the shelf 94 and counterbored recess 78 permits the full area of the cutting face 77 to be exposed to rock formation as the underreamer is used. Such full cutting face exposure at the shelf also gives better cleaning in front of the cutting surfaces by the drilling fluid pumped from the nozzle pin. This in turn minimizes erosion of the steel in front of the cutting surfaces.

The remaining unrelieved portion of the arm that at least partially surrounds the body 82 of the cutter provides mechanical support for the tungsten carbide body on the side opposite the cutting face. Thus, there is relief at the leading face of each cutter for exposing the entire face and mechanical support opposite the leading face of each cutter to avoid premature breakage.

As seen in FIGS. 3 and 6, one of the cutting arms 90 includes a second recessed shelf 95 in front of the innermost of the synthetic diamond cutters. This second shelf permits the innermost cutter to be set deeper into the arm while still leaving the entire cutting face exposed. It is desirable to set the innermost cutter deeper into the arm to assure that the outermost end of the cutter does not interfere with other parts of the underreamer when the arm is in its retracted position, and also to assure that there is adequate mechanical support for the body 82 of the cutter on the opposite side from the leading cutting face.

Except for the gage cutters 58, the synthetic diamond cutters are aligned in a row parallel to the leading side of the arm and spaced apart therefrom. Sufficient steel remains between the cutters and the leading side of the arm so that premature erosion of the steel does not cause loosening or loss of the cutters. It is desirable to place the cutters in a row for convenience in machining the recessed shelf 94. If desired the cutters can be staggered instead of in a row with recessed relief being bored in front of at least some of such cutters.

The gage cutters 58 are each offset from the leading side of the cutting arm a greater distance than the cutters 60 in the row. The gage of the underreamer (i.e., the maximum diameter) is the region at which greatest wear of the cutters is likely to occur. It it therefore desirable to provide a gage cutter on each of the arms for cutting at the gage of the hole. This redundancy assures continued cutting action in the event of damage or wear to one or two of the gage cutters. By offsetting the gage cutters in a circumferential direction relative to the hole being drilled, it is assured that there is ample steel in the body of the arm to support the gage cutter as well as the outermost cutter in the row near the leading side.

The gate cutter at the end of each arm is positioned nearer the trailing side of the arm than are at least a portion of the tungsten carbide inserts 56 on the end face of the arm. The tungsten carbide inserts inhibit wear of the steel at the end of the arm as the underreamer is used. Since the ends of the arms are at the gage of the hole they are subject to considerable abrasion. Erosion of the steel at the end of the arm could permit loss of a gage cutter. The tungsten carbide inserts are placed circumferentially nearer the leading face of the arm than the gage cutters to inhibit such loss of steel. If the inserts were not nearer the leading side, they would not serve to enlarge the hole, if need be, before erosion of steel supporting the gage cutter.

Figure 10:
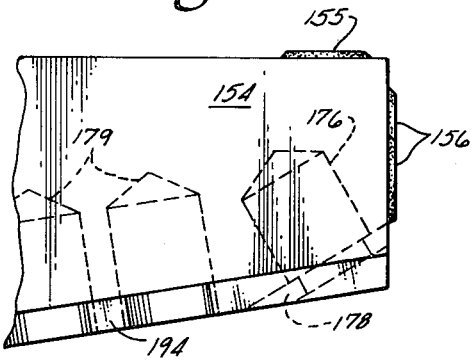
FIG. 10 is a fragmentary side elevation, analogous to FIG. 2, of another embodiment of an underreamer cutting arm.

In the embodiment illustrated in FIGS. 2 through 8 the receptacles 76 and 79 for the diamond faced cutting inserts are bored with parallel axes. It can sometimes be desirable, particularly for smaller diameter underreamers, to provide additional steel for support of the gage cutter at the outer end of each arm. In such an embodiment as illustrated in the fragmentary side view of FIG. 10, the receptacle 176 for receiving the gage cutter is bored at an angle relative to the direction of boring the receptacles 179 for receiving the balance of the diamond faced cutters. Thus, when the cutters are inserted, the gage cutter extends partially radially outwardly from the axis of the underreamer at a greater angle than the balance of the cutters. Stated differently, the gage cutter is at a smaller angle relative to the length of the cutter arm than are the balance of the diamond faced cutters.

In such an embodiment, instead of forming a counterbored recess in front of the cutting face, it is convenient to mill a slot 178 in the direction of the length of the cutting arm to provide relief on the leading side of the gage cutter while maintaining mechanical support for the cutter on the side opposite the leading side.

It can sometimes be desirable to skew some or all of the diamond cutters at a small angle from the edge of the cutting arm. The degree of skew is small and can range from about 10° to about 15° in either direction. While the gage cutter does not have to be at the same angle as the other diamond cutters, preferably these latter cutters are set at the same skew angle when set in a parallel row. Preferably such skewed cutters are skewed so that the cutting face tends to deflect fluid and rock cuttings toward the axis of the underreamer.

Workers skilled in the art to which this invention pertains will appreciate that the description as set forth above pertains to a presently preferred embodiment of the invention, from which other embodiments consistent with the spirit of the description may differ. Accordingly, the description is not intended as an exhaustive catalog of all possible embodiments which this invention may take. Rather the description is intended as illustrative and exemplary, and the claims are presented in that spirit.

What is claimed is:

1. A cutting arm for an underreamer comprising:

a steel body having a leading side, a trailing side, an outer end face and means for connecting the arm to an underreamer;

a plurality of receptacles in the body each containing a tungsten carbide insert;

at least a portion of the tungsten carbide inserts comprising cutters each having a tungsten carbide body supporting a diamond cutting face facing in the same general direction as the leading side of the body and at least one of the cutters being a gage cutter which is adjacent the outer end face of the body for cutting the gate of a hole being reamed; and at least one tungsten carbide insert in the outer end face between the leading side and the body of the gage cutter inserted in the steel body for minimizing erosion of the outer end face between the leading side and the body of the gage cutter.

2. A cutting arm according to claim 1 further comprising at least one auxiliary cutter which is intermediate the gage cutter and the means for connecting the body to an underreamer.

3. A cutting arm according to claim 2 further comprising a recessed region in the cutting arm along its leading side and extending from the leading side to at least the cutting face of such an auxiliary cutter.

4. A cutting arm according to claim 2 wherein the cutting face of the gage cutter is offset away from the leading side a greater distance than the cutting face of such an auxiliary cutter is offset from the leading side.

5. A cutter arm according to claim 2 wherein the gage cutter is tilted toward the body outer end relative to such an auxiliary cutter.

6. A cutting arm according to claim 2 wherein such an auxiliary cutter is skewed at an angle to the body leading side.

7. A cutting arm according to claim 1 further comprising at least two auxiliary cutters in a row parallel to the arm leading side intermediate the gage cutter and the means for connecting the body to an underreamer.

8. A cutting arm according to claim 7 further comprising a recessed region in the body in front of the cutting face of the gage cutter for exposing the full cutting face of the gage cutter while leaving steel behind the cutting face portion of the gage cutter for supporting the gage cutter, and a recessed region in the cutting arm along its leading side and extending from the leading side to at least the cuttings face of the row of auxiliary cutters.

9. A cutting arm according to claim 1 comprising a plurality of tungsten carbide inserts in the end face for engaging the gage of a hole being reamed.

10. A cutting arm according to claim 1 further comprising a recessed region in the body in front of the cutting face of the gage cutter for exposing the full cutting face of the gage cutter while leaving steel behind the cutting face portion of the gage cutter for supporting the gage cutter.

11. A cutting arm according to claim 1 which is a component of a complete set of cutting arms for an underreamer, each of said cutting arms including a gage cutter and a plurality of auxiliary cutters, and where the location of any given one of the cutters is cooperatively related to the gage cutters and to the location of other cutters of the set so that the gage cutters and all the other cutters of the set during operation of the underreamer collectively sweep substantially the entire region of the hole being reamed.

12. A cutting arm according to claim 11 wherein three such cutting arms form a complete set.

13. A cutting arm for an underreamer comprising:

a steel body having a leading side, a trailing side, an outer end face, an inner end, means for connecting the arm to an underreamer, and radial and circumferential directions defined with reference to an underreamer rotational axis in use of the arm, the leading side facing in the circumferential direction into the direction of rotation; and a plurality of receptacles in the body each containing a tungsten carbide insert;

at least a portion of the tungsten carbide inserts comprising cutters each having a diamond cutting face facing in the same general direction as the leading side of the body and at least one of the cutters being a gage cutter which is adjacent the outer end face of the body for cutting the gage of a hole being reamed;

at least one of the cutters being an auxiliary cutter which is intermediate the inner end of the body and the gage cutter for cutting inwardly of the gage of the hole being reamed;

the cutting face of the gage cutter being offset circumferentially away from the leading side relative to the cutting face of such auxiliary cutter.

14. A cutting arm according to claim 13 wherein at least one of the tungsten carbide inserts is in the end face between the leading side and the gage cutter for minimizing erosion of the end face between the leading side and the gage cutter.

15. A cutting arm according to claim 13 comprising a row of such auxiliary cutters parallel to the leading side and a recessed shelf in the body of the cutting arm between the leading side and the cutting faces of the auxiliary cutters extending to at least the cutting face of the auxiliary cutters for exposing the full cutting face of the auxiliary cutters while leaving steel behind the cutting face portion of the auxiliary cutters for supporting the auxiliary cutters.

16. A cutting arm according to claim 13 further comprising a recessed region in the body in front of the cutting face of the gage cutters extending to at least the cutting face of the gage cutters for exposing the full cutting face of the gage cutters while leaving steel behind the cutting face portion of the gage cutters for supporting the gage cutters.

17. A cutting arm according to claim 13 further comprising a recessed region in the body of the cutting arm along its leading side and extending from the leading side to at least the cutting face of such an auxiliary cutter while leaving steel behind the cutting face portion of the auxiliary cutter for supporting the auxiliary cutter.

18. A cutting arm according to claim 13 wherein the gage cutter is tilted toward the body outer end relative to such an auxiliary cutter.

19. A cutting arm for an underreamer comprising:

a steel body having a leading side, a trailing side, an outer end face, an inner end, and means for connecting the arm to an underreamer; and a plurality of receptacles in the body each containing a tungsten carbide insert;

at least a portion of the tungsten carbide inserts comprising cutters each having a diamond cutting face facing in the same general direction as the leading side of the body and at least one of the cutters being a gage cutter which is adjacent the outer end face of the body for cutting the gage of a hole being reamed;

at least one of the cutters being an auxiliary cutter which is intermediate the inner end of the body and the gage cutter for cutting inwardly of the gage of the hole being reamed;

the cutting face of the gage cutter being offset from the leading side by a first distance, and the cutting face of such an auxiliary cutter being offset from the leading side by a second distance which is less than the first distance.

20. A cutting arm according to claim 19 further comprising a recessed region in the body in front of the cutting face of the gage cutter.

21. A cutting arm according to claim 19 wherein there is an inner auxiliary cutter, and at least one intermediate auxiliary cutter between the inner cutter and the gage cutter forming a row with the inner cutter, the row extending parallel to the arm leading side.

22. A cutting arm according to claim 21 further comprising a recessed region in the cutting arm along its leading side and extending from the leading side to the cutting faces of such intermediate cutter and inner cutter.

23. A cutting arm for an underreamer comprising:

a steel body having a leading side, a trailing side, an outer end face, an inner end, and means for connecting the arm to an underreamer;

a plurality of tungsten carbide inserts, each in a receptacle in the body;

at least a portion of the tungsten carbide inserts comprising cutters each having a diamond cutting face facing in the same general direction as the leading side of the body and at least one of the cutters being a gage cutter which is adjacent the outer end face of the body for cutting the gage of a hole being reamed;

at least one of the cutters being an auxiliary cutter which is intermediate the inner end of the body and the gage cutter for cutting inwardly of the gage of the hole being reamed; and a recessed region in the body in front of the cutting face of the gage cutter for exposing the full cutting face of the gage cutter while leaving steel behind the cutting face portion of the gage cutter for supporting the gage cutter.

24. A cutting arm according to claim 23 wherein at least one tungsten carbide insert is in the end face between the leading side and the gage cutter for minimizing erosion of the end face between the leading side and the gage cutter.

25. A cutting arm according to claim 23 wherein the recessed region in front of the cutting face of the gage cutter is counterbored into the body.

26. A cutting arm according to claim 23 further comprising a recessed region in the cutting arm along its leading side and extending from the leading side to at least the cutting face of such an auxiliary cutter.

27. A cutting arm according to claim 23 wherein the gage cutter is offset away from the leading side a greater distance than such an auxiliary cutter is offset from the leading side.

28. A cutting arm for an underreamer comprising:

a steel body having a leading side, a trailing side, an outer end face, an inner end, and means for connecting the arm to an underreamer;

a plurality of tungsten carbide inserts mounted in the body;

at least a portion of the tungsten carbide inserts comprising cutters each having a diamond cutting face facing in the same general direction as the leading side of the body and at least one of the cutters being a gage cutter which is adjacent the outer end face of the body for cutting the gage of a hole being reamed;

at least two of the cutters being auxiliary cutters which are intermediate the inner end of the body and the gage cutter for cutting inwardly of the gage of the hole being reamed, the auxiliary cutters being aligned in a row parallel to the arm leading side so that there is an innermost cutter; and a recessed region in the body along its leading side extending from the leading side to at least the cutting faces of such auxiliary cutters for exposing the full cutting faces of such auxiliary cutters while leaving steel behind the cutting face portions of such auxiliary cutters for supporting such auxiliary cutters.

29. A cutting arm according to claim 28 further comprising a further recessed region in the body along its leading side extending from the leading side to at least the cutting face of the innermost cutter.

30. A cutting arm according to claim 28 which is a component of a complete set of cutting arms for an underreamer, each of said cutting arms including a gage cutter and a plurality of auxiliary cutters, and where the location of any given one of the auxiliary cutters is cooperatively related to the gage cutters and to the location of other cutters of the set so that the gage cutters and all the other cutters of the set during operation of the underreamer collectively sweep substantially the entire region of the hole being reamed.

31. A cutting arm for an underreamer comprising:

a steel body having a leading side, a trailing side, an outer end face, an inner end, means for connecting the arm to an underreamer, and a radial direction defined by reference to an underreamer rotational axis in use of the arm; and a plurality of receptacles in the body each containing a tungsten carbide insert;

the tungsten carbide inserts comprising cutters each having a diamond cutting face facing in the same general direction as the leading side of the body, one of the cutters being a gage cutter which is adjacent the outer end face of the body for cutting the gage of a hole being reamed;

the balance of the cutters being auxiliary cutters which are in a row parallel to the leading side intermediate the inner end of the body and the gage cutter for cutting inwardly of the gage of the hole being reamed;

the gage cutter and the auxiliary cutters each forming an angle with respect to the body radial direction, the gage cutter being outwardly tilted relative to the auxiliary cutters whereby the angle formed by the gage cutter is smaller than the corresponding angle formed by the auxiliary cutters; and wherein the gage cutter is offset from the leading side a greater distance than the row of auxiliary cutters is offset from the leading side.

32. A cutting arm according to claim 31 wherein the corresponding angle formed by the auxiliary cutters is not more than about 30° greater than the angle formed by the gage cutter.

33. A cutting arm according to claim 31 further comprising at least one tungsten carbide insert in the end face between the leading side and the gage cutter for minimizing erosion of the end face between the leading side and the gage cutter.

34. A cutting arm for an underreamer, the arm comprising hinge means near one end of the arm for incorporation of the cutting arm in an underreamer for motion between a retracted position approximately aligned with the axis of the underreamer and a deployed position extending laterally from the underreamer, the arm having, relative to rotation of the underreamer in operation, a leading side and a trailing side and an outer end face which is opposite the arm hinged end, and a first synthetic diamond gage cutter on the arm adjacent the outer end face having a cutting edge exposed toward the arm leading side which is offset a first distance from the leading side for cutting the gage of a hole being reamed, and at least one other synthetic diamond cutter on the arm between the first diamond gage cutter and the arm hinged end and having a cutting edge exposed toward the arm leading side, the cutting edge of such a cutter being offset from the leading side a second distance which is less than the first distance.

35. A cutting arm according to claim 34 further comprising a recessed region in the cutting arm in front of the cutting edge of the first synthetic diamond gage cutters.

36. A cutting arm according to claim 34 comprising at least one tungsten carbide insert in the arm end face between the leading side and the gage cutter for minimizing erosion of the end face between the leading side and the gage cutter.

37. An underreamer comprising:

a tubular body adapted for connection to a drill string or the like, the body having at least one recess for receiving a cutting arm;

a cutting arm mounted in each such recess;

the cutting arm having a plurality of synthetic diamond cutting edges including a first synthetic diamond gage cutter having a tungsten carbide body supporting a diamond cutting edge and at least one other synthetic diamond cutter having a tungsten carbide body supporting a diamond cutting edge, the gage cutter being near an outer face of the arm and having its cutting edge offset from a leading side of the arm a first distance, such other synthetic diamond cutter being disposed between the first gage cutter and an arm inner end and having its cutting edge offset from the leading side of the arm a distance less than the first distance;

means for connecting the cutting arm to the body for moving between a retracted position approximately aligned with the axis of the body and a deployed position extending laterally outwardly of the body;

hydraulic piston means for actuating the cutting arm from the retracted position to the deployed position;

spring biasing means in cooperation with the piston means and the cutting arm for resiliently urging the cutting arm from the deployed position toward the retracted position; and nozzle means downstream from the connecting means and in communication with the hydraulic piston means and cooperating with the recess so that, upon actuation of the cutting arm away from the retracted position, fluid from the hydraulic piston means communicates through the nozzle and the recess to flood around the cutting arm at the synthetic diamond cutters.

38. An underreamer according to claim 37 further comprising a plug in cooperation with the piston means for alternately permitting or restricting fluid communication with the nozzle means, such communication being restricted when the piston means is in a first position corresponding to full retraction of the cutting arm, such communication being otherwise permitted.

39. An underreamer according to claim 37 wherein the plug and the piston means are coaxial with the body.

40. An underreamer according to claim 37 having at least two such cutting arms, each of said arms having a gage cutter for cutting the gage of a hole being reamed.

41. An underreamer according to claim 40 having three such cutting arms.

42. An underreamer according to claim 40 wherein the location of the other synthetic diamond cutters in the arms is such that the gage cutters and such other cutters collectively sweep substantially the entire region being reamed by the cutting arms.

43. An underreamer according to claim 37 further comprising at least one tungsten carbide insert in the cutting arm outer face between the arm leading side and the gage cutter for minimizing erosion of the arm outer face between the leading side and the gage cutter.

44. An underreamer according to claim 37 wherein the gage cutter is tilted outwardly from the axis of the underreamer tubular body a greater angle than to such other synthetic diamond cutters.

45. An underreamer according to claim 44 wherein the cutting edges of at least a portion of such other cutters are skewed away from the arm leading side by an angle of up to about 15°.

46. An underreamer according to claim 37 where there are at least two of the other synthetic diamond cutters in a row parallel to the cutting arm leading side.

47. An underreamer according to claim 46 wherein the cutting arm further comprises a recessed region along the arm leading side and extending from the leading side to at least such other cutters.

48. An underreamer according to claim 37 wherein the cutting arm further comprises a recessed region in front of the gage cutter.

49. An underreamer comprising:

a tubular body for connection to a drill string or the like, the body having at least one recess for receiving a cutting arm;

a cutting arm mounted in each such recess comprising a steel body having a leading side, a trailing side and an outer end face and means for connecting the arm to the underreamer body;

a plurality of tungsten carbide inserts mounted in the steel body, at least a portion of such inserts each having a diamond cutting face facing in the same general direction as the leading side of the steel body and at least one of the diamond cutting faces being a gage cutter which is adjacent the steel body outer end face for cutting the gage of a hole being reamed the cutting face of, the gage cutter being offset circumferentially relative to the underreamer axis farther away from the steel body leading side than at least one other of the diamond cutting faces;

actuation means in the tubular body for moving such a cutting arm between a retracted position in such a recess approximately aligned with the axis of the tubular body and a deployed position extending laterally outwardly of the body; and nozzle means in the tubular body in cooperation with the actuation means and the recess whereby, upon movement of the cutting arm away from the retracted position, fluid supplied to the tubular body from the drill string or the like communicates through the nozzle means and the recess to flood the hole being reamed at the diamond cutting faces.

50. An underreamer according to claim 49 having at least two such cutting arms, each of such arms including a gage cutter.

51. An underreamer according to claim 50 wherein the location of the other diamond cutting faces in the arms is such that the gage cutters and such other diamond cutting faces collectively sweep substantially the entire region being reamed from the hole during rotation of the underreamer.

52. An underreamer according to claim 51 having three such cutting arms.

53. An underreamer according to claim 49 wherein at least one tungsten carbide insert is in the cutting arm end face between the leading side and the gage cutter for minimizing erosion of the end face between the leading side and the gage cutter.

54. An underreamer according to claim 49 wherein the gage cutter is tilted outwardly away from the axis of the underreamer body a greater angle than such other diamond cutting face.

55. An underreamer according to claim 49 wherein the cutting arm further comprises a recessed region in front of the gage cutter for fully exposing the cutting face of the gage cutter.

56. An underreamer according to claim 44 comprising a row of such other diamond cutting faces in the arm extending parallel to the leading side of the steel body.

57. An underreamer according to claim 56 comprising a recessed region in the cutting arm along its leading side and extending from the leading side to the row of such other diamond cutting faces.

58. An underreamer according to claim 44 comprising a recessed region in the cutting arm steel body along its leading side and extending from the leading side to at least one of such other of the diamond cutting faces.

* * * * *